US010501868B2

(12) United States Patent
Kodama

(10) Patent No.: US 10,501,868 B2
(45) Date of Patent: Dec. 10, 2019

(54) ELECTROSPINNING DEVICE AND NANOFIBER MANUFACTURING DEVICE PROVIDED WITH SAME

(71) Applicant: KAO CORPORATION, Tokyo (JP)

(72) Inventor: Shinji Kodama, Shimotsuke (JP)

(73) Assignee: KAO CORPORATION, Tokyo (JP)

( * ) Notice: Subject to any disclaimer, the term of this patent is extended or adjusted under 35 U.S.C. 154(b) by 392 days.

(21) Appl. No.: 14/435,058

(22) PCT Filed: Oct. 8, 2013

(86) PCT No.: PCT/JP2013/077314
§ 371 (c)(1),
(2) Date: Apr. 10, 2015

(87) PCT Pub. No.: WO2014/057927
PCT Pub. Date: Apr. 17, 2014

(65) Prior Publication Data

US 2015/0275399 A1 Oct. 1, 2015

(30) Foreign Application Priority Data

Oct. 11, 2012 (JP) ..... 2012-226043
Oct. 4, 2013 (JP) ..... 2013-209331

(51) Int. Cl.
*D01D 5/00* (2006.01)

(52) U.S. Cl.
CPC ..... *D01D 5/0061* (2013.01); *D01D 5/0007* (2013.01)

(58) Field of Classification Search
None
See application file for complete search history.

(56) References Cited

U.S. PATENT DOCUMENTS

2002/0122840 A1 9/2002 Lee et al.
2004/0076661 A1* 4/2004 Chu ..... A61K 9/0024 424/443

(Continued)

FOREIGN PATENT DOCUMENTS

CN 1849418 B 7/2012
CN 102597341 A 7/2012

(Continued)

OTHER PUBLICATIONS

Teo, "A review on electrospinning design and nanofibre assemblies", Nanotechnology 17 (2006) R89-R106.*

(Continued)

*Primary Examiner* — Joel G Horning
(74) *Attorney, Agent, or Firm* — Birch, Stewart, Kolasch & Birch, LLP

(57) ABSTRACT

An electrospinning device 1 includes an electrode 10 having a concave curved surface 11 and a needle-shaped spinning nozzle 20 surrounded by the concave curved surface 11 of the electrode 10. With an electric field applied between the electrode 10 and the nozzle 20, a spinning solution is jetted from the tip of the nozzle 20 to form a nanofiber. The nozzle 20 is located such that the direction in which the nozzle 20 extends passes through or near the center of a circle defined by the open end of the concave curved surface 11 of the electrode 10 and that the tip 20*a* of the nozzle 20 is positioned in or near the plane including the circle defined by the open end.

9 Claims, 11 Drawing Sheets

(56) References Cited

U.S. PATENT DOCUMENTS

| | | | |
|---|---|---|---|
| 2006/0290031 | A1 | 12/2006 | Jirsak et al. |
| 2008/0029617 | A1 | 2/2008 | Marshall et al. |
| 2008/0258351 | A1 | 10/2008 | Shieh et al. |
| 2010/0072674 | A1 | 3/2010 | Takahashi et al. |
| 2010/0173035 | A1 | 7/2010 | Shieh et al. |
| 2011/0135806 | A1 | 6/2011 | Grewe et al. |
| 2011/0250308 | A1 | 10/2011 | Jun et al. |
| 2012/0242010 | A1 | 9/2012 | Ishikawa et al. |
| 2013/0011508 | A1 | 1/2013 | Kim |
| 2013/0142852 | A1 | 6/2013 | Tojo et al. |
| 2015/0275399 | A1 | 10/2015 | Kodama |

FOREIGN PATENT DOCUMENTS

| | | | |
|---|---|---|---|
| CN | 102652189 | A | 8/2012 |
| CN | 102776582 | A | 11/2012 |
| JP | 2006-283240 | A | 10/2006 |
| JP | 2008-223186 | A | 9/2008 |
| JP | 2009-13535 | A | 1/2009 |
| JP | 2009-531561 | A | 9/2009 |
| JP | 2010-59557 | A | 3/2010 |
| JP | 2010-180499 | A | 8/2010 |
| JP | 2010-189782 | A | 9/2010 |
| JP | 2011-102455 | A | 5/2011 |
| JP | 2011-127234 | A | 6/2011 |
| JP | 2011-127262 | A | 6/2011 |
| JP | 2011-140740 | A | 7/2011 |
| JP | 2012-12317 | A | 1/2012 |
| JP | 2012-107364 | A | 6/2012 |
| JP | 2014-111860 | A | 6/2014 |
| KR | 10-2010-0078784 | A | 7/2010 |
| WO | WO 02/092888 | A1 | 11/2002 |
| WO | WO 2005/042813 | A1 | 5/2005 |
| WO | WO 2012/066929 | A | 5/2012 |
| WO | WO 2014/057927 | A1 | 4/2014 |

OTHER PUBLICATIONS

Extended European Search Report dated May 13, 2016, for European Application No. 13844962.4.

International Search Report, issued in PCT/JP2013/077314, dated Jan. 14, 2014.

Written Opinion of the International Searching Authority, issued in PCT/JP2013/077314, dated Jan. 14, 2014.

English translation of the Written Opinion of the International Searching Authority (Form PCT/ISA/237), dated Nov. 11, 2014, for International Application No. PCT/JP2014/070820.

Extended European Search Report, dated Dec. 6, 2016, for European Application No. 14834044.1.

International Search Report (Form PCT/ISA/210), dated Nov. 11, 2014, for International Application No. PCT/JP2014/070820.

Kim, "Electrospinning process using field-controllable electrodes," Journal of Polymer Science: Part B: Polymer Physics, vol. 44, No. 10, Apr. 7, 2006, pp. 1426-1433.

* cited by examiner

Fig. 7(a) Invention
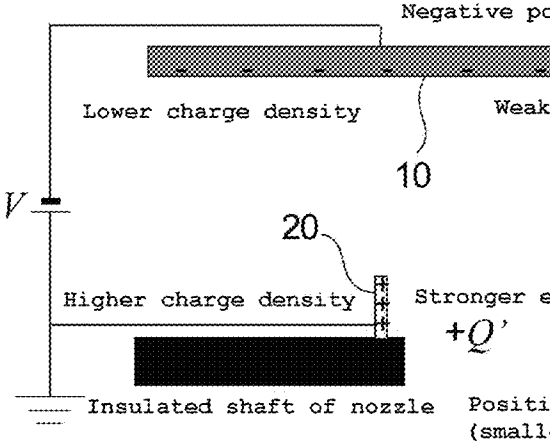
Fig. 7(b) Convention technique
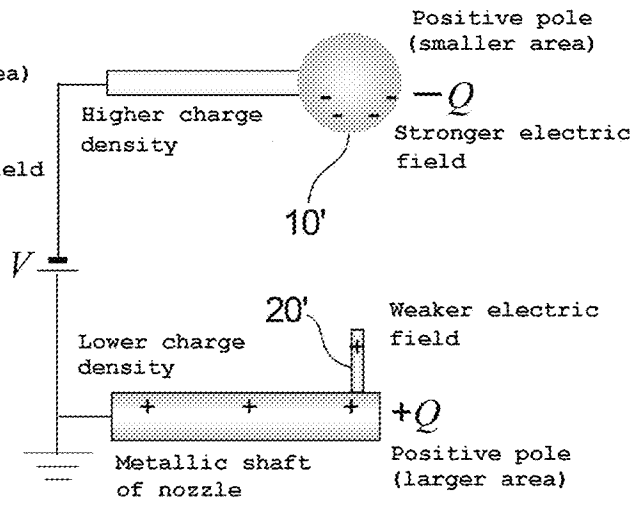

Fig. 12(a) Example 1
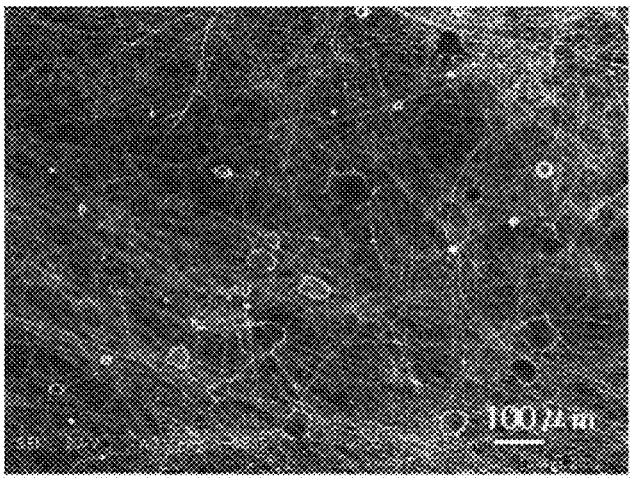
Fig. 12(b) Example 1 (Enlareged)
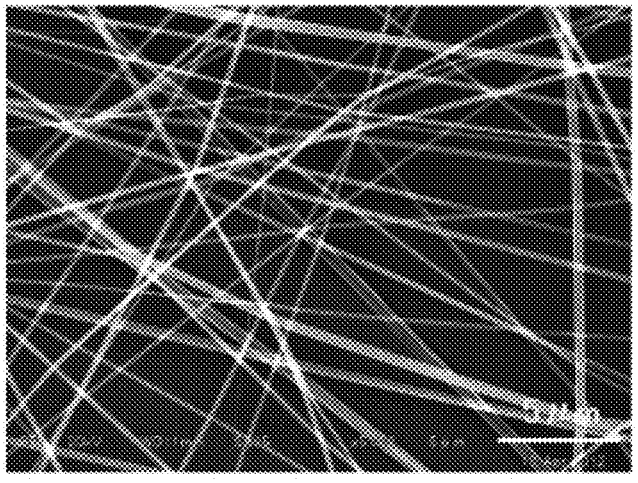

Fig. 13(a) Comparative Example 1
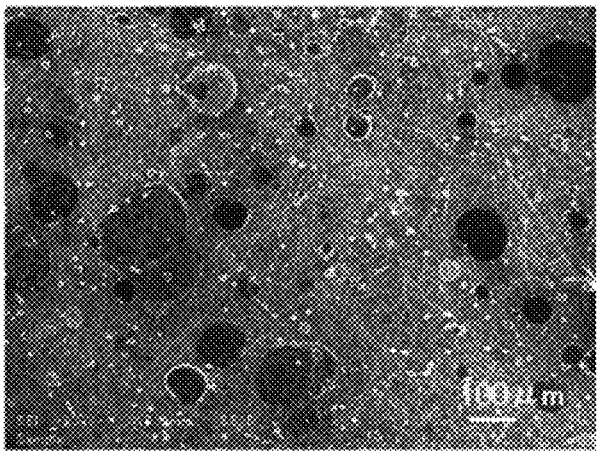
Fig. 13(b) Comparative Example 1 (Enlarged)
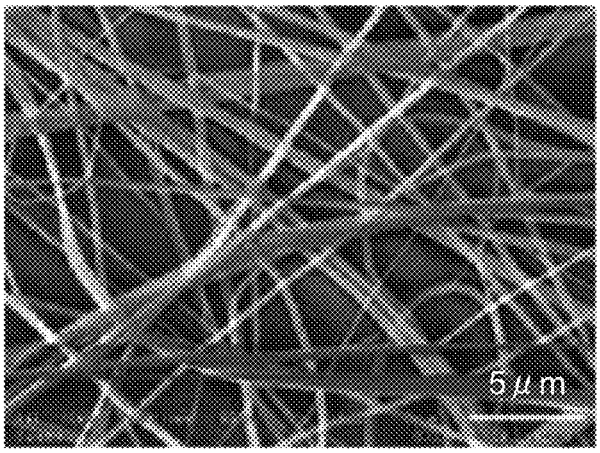
Fig. 13(c) Comparative Example 1(Enlarged Beads)
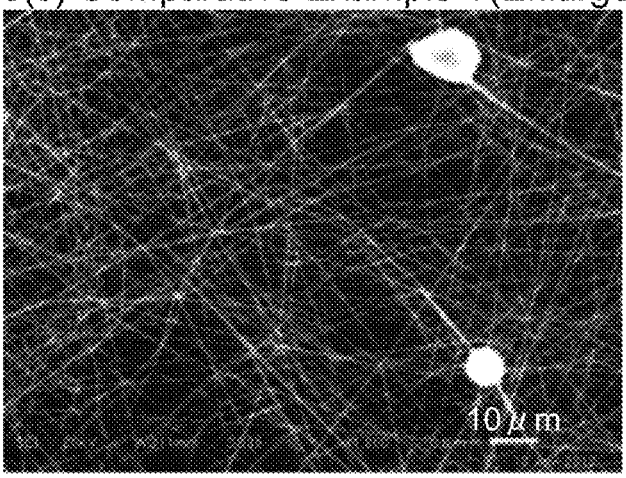

Fig. 14(a) Comparative Example 2
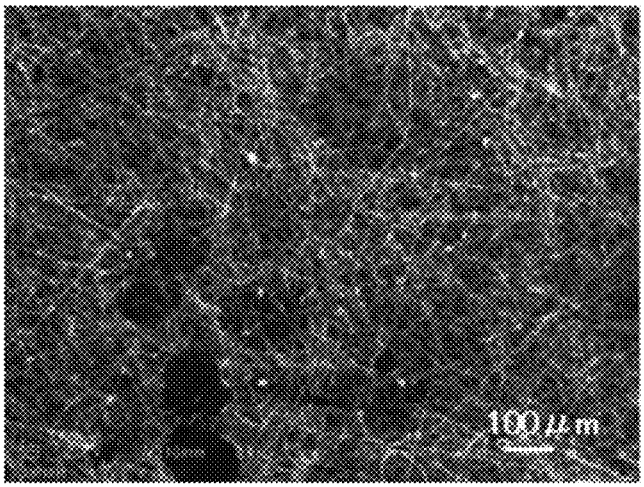
Fig. 14(b) Comparative Example 2 (Enlarged)
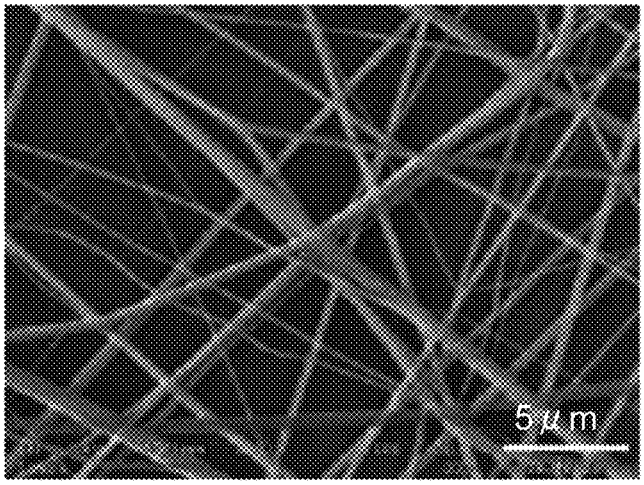

ELECTROSPINNING DEVICE AND NANOFIBER MANUFACTURING DEVICE PROVIDED WITH SAME

TECHNICAL FIELD

The present invention relates to an electrospinning device and a nanofiber producing apparatus having the electrospinning device.

BACKGROUND ART

An electrospinning process (ES process) is attracting attention as a technique that allows for relatively easy production of nanosized particles and fibers without using a mechanical or thermal force. A conventional ES process includes loading a solution of a nanofiber material into a syringe having a needle at its tip and jetting the solution from the needle while applying a high direct voltage between the needle and a collecting electrode. The solvent of the jetted solution evaporates instantaneously in the electric field, and the material is drawn by coulomb force while coagulating into a nanofiber, which deposits on the collecting electrode.

The above described conventional ES process is capable of producing only one or a few nanofibers from one needle. A technology for quantity production of nanofibers has not yet been established, and practical application of the ES process has made only slow progress.

ES processes described in Patent Literatures 1 to 5 below were proposed for increasing the nanofiber productivity. The ES process described in Patent Literature 1 includes providing a rotating conductive cylindrical container having a plurality of small openings with a polymer solution prepared by dissolving a polymer in a solvent, rotating the cylindrical container, thereby jetting the charged polymer solution from the small openings, drawing the jetted streams of the polymer solution into nanofibers by centrifugal force and electrostatic burst resulting from evaporation of the solvent, and deviating the nanofibers toward a second side of the axial direction of the cylindrical container by a repulsive electrode and/or an air blowing means disposed on a first side of the axial direction of the cylindrical container.

Patent Literature 1 discloses another ES process, in which an annular electrode is disposed to surround the lateral surface of a rotating conductive container having a plurality of small openings to provide a spinning space between the rotating container and the annular electrode. A polymer solution is fed to the container, and the container is rotated with a high voltage applied between the annular electrode and the vicinities of the small openings of the container to generate an electric field in the spinning space, whereby the polymer solution is jetted through the small openings and spun into charged fibers by centrifugal force and the action of the electric field. The fibers are drawn into nanofibers out of the spinning space by electrostatic burst associated with evaporation of the solvent.

According to the ES process disclosed in Patent Literatures 2 and 3, a solution of a polymer material is jetted from a metallic spinning nozzle with a high voltage applied between the nozzle and a metallic ball while a high speed air jet is directed perpendicular to the line connecting the metallic ball and the opening of the spinning nozzle, whereby the nanofiber spun from the nozzle is deviated and flown to the nanofiber collector where it is collected.

According to the ES process of Patent Literature 4, a resin-made nozzle is used to spray a spinning solution, a spinning solution is charged by an electrode, and the charged spinning solution is spray spun into an electric field. The container containing the spinning solution has, inside, an electrode made of a conductive material for charging the spinning solution.

CITATION LIST

Patent Literature

Patent Literature 1: US2010/0072674A1
Patent Literature 2: JP 2011-127234A
Patent Literature 3: WO 2012-066929
Patent Literature 4: JP 2011-102455A

SUMMARY OF INVENTION

The above discussed ES processes can still have insufficient productivity or cannot be said to be economically advantageous because of the need of complicated equipment or a large equipment space.

The present invention provides an electrospinning device including an electrode having a concave curved surface and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution. The concave curved surface of the electrode having an open end defining a circle. In the electrospinning device, the nozzle is located in such a manner that a direction in which the nozzle extends passes through or near the center of the circle defined by the open end of the concave curved surface of the electrode, and that the tip of the nozzle is positioned in or near a plane including the circle defined by the open end of the concave curved surface of the electrode.

The invention also provides an apparatus for producing a nanofiber including; the above-mentioned electrospinning device; a gas jetting part positioned near a base of the nozzle of the electrospinning device and configured to jet a gas stream along a direction, in which the nozzle extends, toward the tip of the nozzle; a nanofiber collecting electrode facing the tip of the nozzle; and a spinning solution feed unit for feeding the spinning solution to the nozzle.

BRIEF DESCRIPTION OF DRAWINGS

FIG. 7(*a*) is a model diagram representing the principle of the electrospinning device of the invention. FIG. 7(*b*) is a model diagram representing the principle of a conventional electrospinning device.

FIG. 12(*a*) is a scanning electron micrograph of the nanofibers obtained in Example 1, and FIG. 12(*b*) is an enlarged image of FIG. 12(*a*).

FIG. 13(*a*) is a scanning electron micrograph of the nanofibers obtained in Comparative Example 1, and FIG. 13(*b*) and FIG. 13(*c*) are each an enlarged image of FIG. 13(*a*).

FIG. 14(*a*) is a scanning electron micrograph of the nanofibers obtained in Comparative Example 2, and FIG. 14(*b*) is an enlarged image of FIG. 14(*a*).

DESCRIPTION OF EMBODIMENTS

The inventor has conducted extensive studies on the production of nanofibers from a spinning solution and found, as a result, that the coulomb force acting on the spinning solution is a very important factor for reducing the thickness of the nanofibers. As a result of further investigations, he has reached the finding that the nanofiber production capacity per spinning nozzle increases with an increase of the amount of charges per unit mass of the spinning solution, thereby to bring about increased nanofiber productivity while suppressing the increase in size of production equipment.

Figure 1:
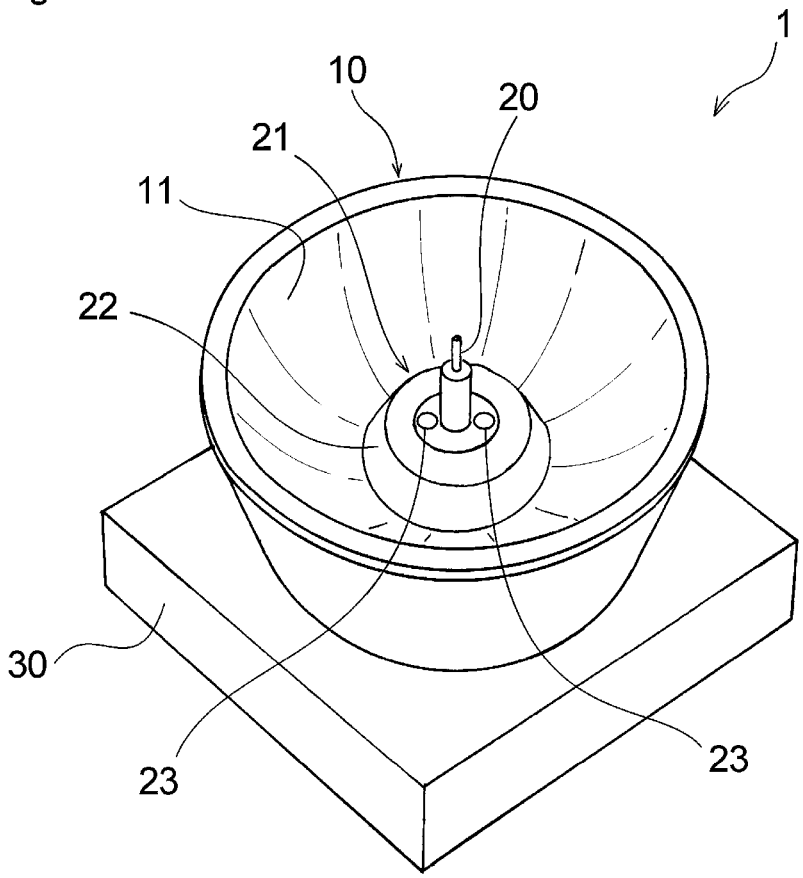
FIG. 1 is a perspective showing an embodiment of the electrospinning device according to the invention.
Figure 2:
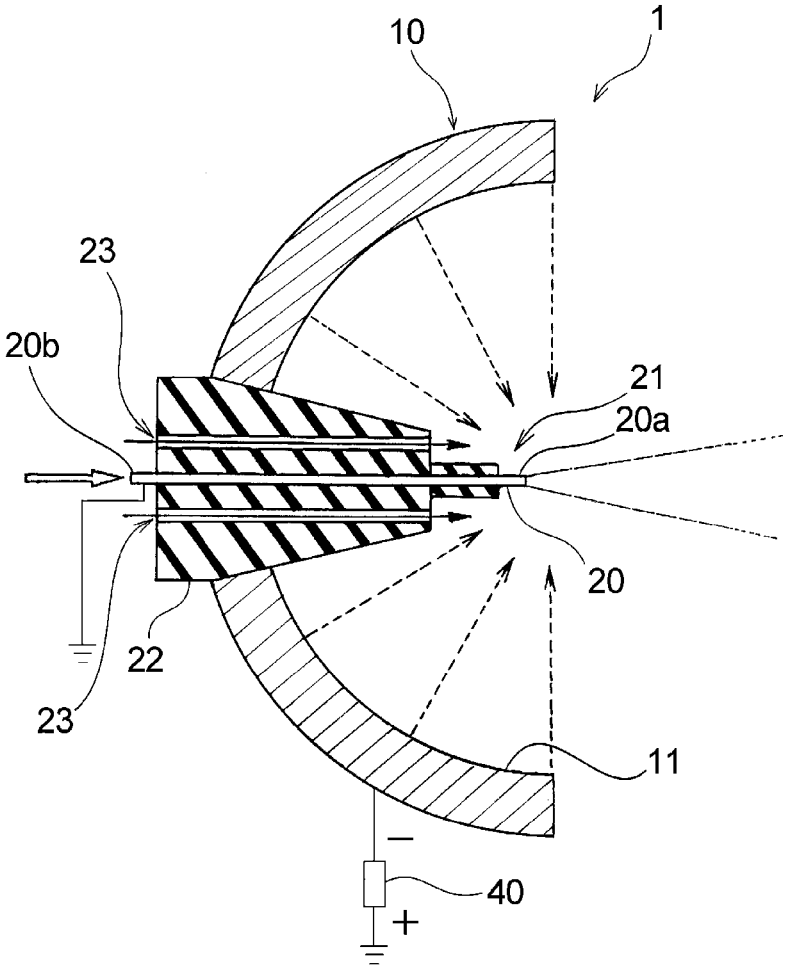
FIG. 2 is a schematic showing a cross-sectional structure of the electrospinning device of FIG. 1.
Figure 3A:
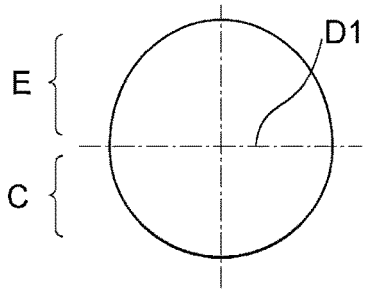
FIG. 3(*a*), FIG. 3(*b*), FIG. 3(*c*), and FIG. 3(*d*) are plans showing various shapes of the open end of the electrode of the electrospinning device.
Figure 3B:
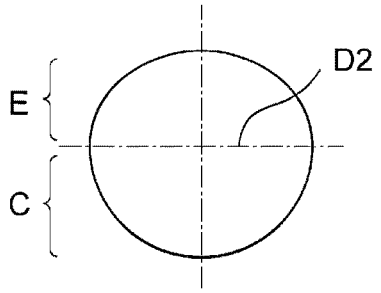
Figure 3C:
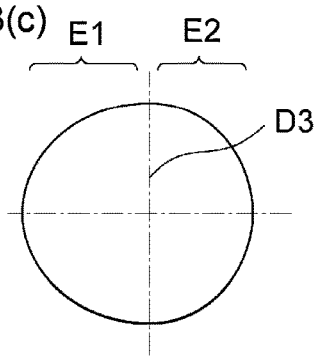
Figure 3D:
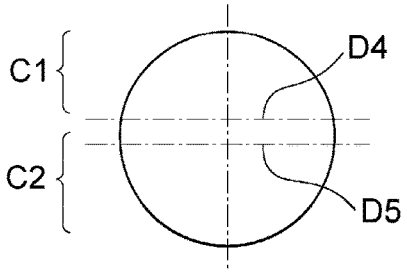

The present invention will be described largely based on its preferred embodiments with reference to the accompanying drawings. FIG. 1 is a perspective of an embodiment of the electrospinning device of the invention, and FIG. 2 is a schematic illustrating a cross-sectional structure of the electrospinning device of FIG. 1. The electrospinning device 1 illustrated in FIG. 1 includes an electrode 10 and a nozzle 20 for jetting a spinning solution.

The electrode 10 has a substantially bowl shape having a concave curved surface 11 on its inner side. As long as the inner surface of the electrode 10 is a concave curved surface 11, the electrode does not need to be substantially bowl shape and may have other shapes. The concave curved surface 11 is formed of an electrically conductive material and is usually made of metal. The electrode 10 is fixed to a base 30 made of an electrically insulating material. As illustrated in FIG. 2. the electrode 10 is connected to a high direct voltage power source 40.

The open end of the concave curved surface 11 is circular when viewed from the open end side. As used herein, the term "circular" includes not only true circular but also elliptic. In order to concentrate electric charges at the tip of the nozzle 20, the shape of the open end of the concave curved surface 11 is preferably true circular as will be discussed later. When the open end shape is not a true circle, it may be a combination of a circle C and an ellipse E as represented by FIGS. 3(*a*) and 3(*b*). The shape of FIG. 3(*a*) is a combination of a circle C with a diameter D1 and an ellipse E with a minor axis D1, of which the upper half is a semiellipse containing both ends of the minor axis D1, and the lower half is a semicircle with the diameter D1. The shape of FIG. 3(*b*) is a combination of a true circle C with a diameter D2 and an ellipse E with a major axis D2, of which the upper half is a semiellipse containing both ends of the major axis D2, and the lower half is a semicircle with the diameter D2. The open end shape may also be a combination of two ellipses E1 and E2 as shown in FIG. 3(*c*). The shape shown in FIG. 3(*c*) is a combination of the ellipse E1 with a minor axis D3 and the ellipse E2 with a major axis D3, of which the left half is a semiellipse containing both ends of the minor axis D3, and the right half is a semiellipse containing both ends of the major axis D3. The open end shape may also be a combination of two circles C1 and C2 as shown in FIG. 3(*d*). In FIG. 3(*d*), the central axis of the first circle C1 and that of the second circle C2 are located on the same line which is located in a plane including the first circle C1 and the second circle C2, and the center of the first circle C1 and that of the second circle C2 are not coincident with each other. The diameter of the first circle C1 is smaller than that of the second circle C2.

Figure 4:
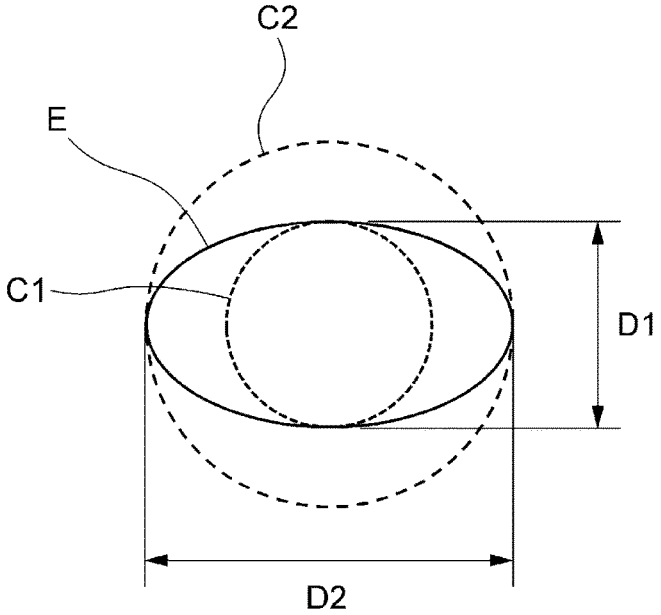
FIG. 4 is a plan showing another shape of the open end of the electrode of the electrospinning device.

When the open end of the concave curved surface 11 is elliptic as illustrated in FIG. 4, a ratio of the diameter D1 of an inscribed circle C1 of the ellipse E to the diameter D2 of a circumscribed circle C2 of the ellipse E, D1/D2, is preferably 9/16 or larger, more preferably 3/4 or larger, even more preferably 4/5 or larger.

Figure 5:
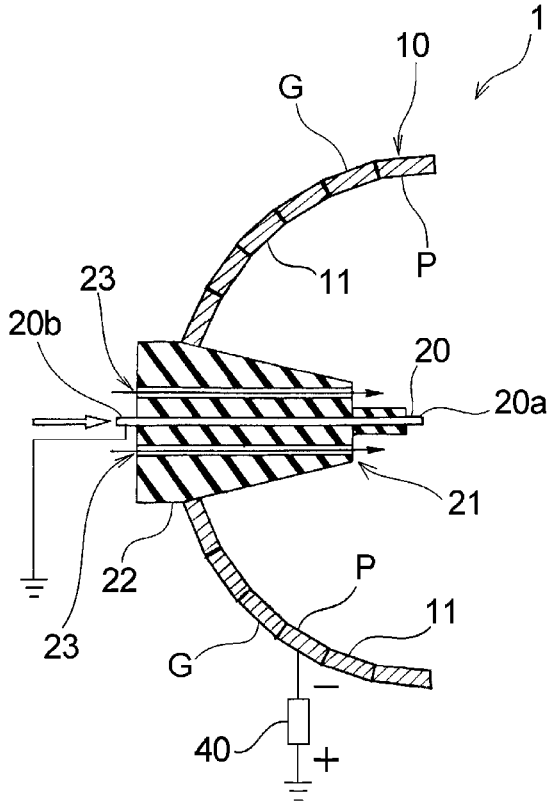
FIG. 5 is a schematic showing a cross-sectional structure of another embodiment of the electrospinning device (equivalent to FIG. 2).
Figure 6:
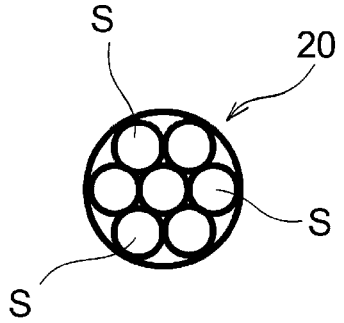
FIG. 6 is a schematic transverse cross-section of a nozzle.

The concave curved surface 11 is curved at any position. As used herein, the term "curved surface" is meant to include (i) a curved surface having no flat portion, (ii) a concave, seemingly curved surface that is formed by connecting a plurality of segments G each having a flat surface P as illustrated in FIG. 5, and (iii) a concave, seemingly curved surface formed by connecting a plurality of annular segments each having a belt-like portion with no curvature on one of three perpendicular axes. In the case of (ii), the concave curved surface 11 is preferably formed by connecting segments G having a rectangular flat surface P of the same or different sizes, e.g., with a length and a width ranging from about 0.5 to 5 mm. In the case of (iii), the concave curved surface 11 is preferably formed by connecting annular segments having the shape of a flattened cylinder, e.g., with a height of 0.001 to 5 mm and a varied radius. Of the three perpendicular axes (x-, y-, and z-axes) of each annular segment, the x-axis and y-axis containing a transverse cross-section of the cylinder have a curvature, and the z-axis (the direction of height of the cylinder) has no curvature.

The concave curved surface 11 preferably has such a curvature that a normal at any position of concave curved surface 11 passes through or near the tip of the nozzle 20. From that viewpoint, the concave curved surface 11 is preferably shaped to the inner surface of a true spherical shell.

As illustrated in FIGS. 1 and 2, the concave curved surface 11 has an opening at the bottom, and a nozzle assembly 21 is fitted into the opening. Therefore, when the concave curved surface 11 has the shape of the inner surface of a true spherical shell, the concave curved surface 11 takes on the shape of the inner surface of a spherical zone.

The nozzle assembly 21 includes the above described nozzle 20 and a support 22 supporting the nozzle 20. The nozzle 20 is made of an electrically conductive material, usually a metal. The support 22 is made of an electrically insulating material. Therefore, the electrode 10 and the nozzle 20 are electrically insulated from each other by the support 22. The nozzle 20 goes completely through the support 22 with its tip 20*a* exposed to the space surrounded by the concave curved surface 11 of the electrode 10. The opposite bottom end 20*b* of the nozzle 20 is exposed in the back side (i.e., the opposite side to the concave curved surface 11) of the electrode 10 and is connected to a spinning solution feed source (not shown).

The nozzle 20 made of a conductive material is constituted by a needle-like straight tube through which a spinning solution is allowed to flow. The inner diameter of the nozzle 20 is preferably 200 μm or more, more preferably 300 μm or more, and preferably 3000 μm or less, more preferably 2000 μm or less. Accordingly, the inner diameter of the nozzle 20 preferably ranges from 200 μm to 3000 μm, more preferably from 300 μm to 2000 μm. When inner diameter of the nozzle 20 is in that range, a spinning solution, i.e., a polymer solution is delivered smoothly at a constant rate and is electrically charged efficiently.

The nozzle 20 may be divided into a plurality of sections S in its transverse cross-section so that the spinning solution may flow through each section S. In that case, the contact area between the spinning solution and the inner wall of the nozzle 20 increases to facilitate electrical charging of the spinning solution. In the case where the nozzle 20 is divided into a plurality of sections S in its transverse cross-section, the term "inner diameter of the nozzle 20" as used above refers to the inner diameter of each section S. The shape and inner diameter of the sections may be the same or different.

The nozzle 20, which is made of a conductive material as described above, is grounded as indicated in FIG. 2. Because a negative voltage is applied to the electrode 10, an electric field generates between the electrode 10 and the nozzle 20. An electric field between the electrode 10 and the nozzle 20 may be generated by applying a positive voltage to the nozzle 20 with the electrode 10 grounded instead of the manner of voltage application shown in FIG. 2. Nevertheless, grounding the nozzle 20 is preferable to applying a positive voltage to the nozzle 20 in terms of a simpler measure for insulation.

In order to sufficiently charge the spinning solution, the potential difference between the electrode 10 and the nozzle 20 is preferably 1 kV or more, more preferably 10 kV or more. In order to prevent a discharge between the nozzle and the electrode, the potential difference is preferably 100 kV or less, more preferably 50 kV or less. For example, the potential difference is preferably 1 kV to 100 kV, more preferably 10 kV to 50 kV.

The electrospinning device 1 of the present embodiment achieves charging using the principle of electrostatic induction. Electrostatic induction is a phenomenon that causes a conducting object in a stable state to be polarized when a charged object is brought near the uncharged conducting object. For example, if a positive charge is brought near the conducting object, internal negative charges in the conducting object will be attracted toward it, while internal positive charges move away from it. With the charged object near the conducting object, when the positively charged side of the conducting object is connected to ground, the internal positive charges are electrically neutralized, and the conducting object becomes a negatively charged object. In the embodiment shown in FIG. 2, since the electrode 10 is used as a negatively charged object, the nozzle 20 becomes a positively charged object. Therefore, while a spinning solution flows in the positively charged nozzle 20, positive charges are supplied from the nozzle 20 to positively charge the spinning solution.

FIG. 7(*a*) represents a model diagram showing the electric field and charge distribution in the electrospinning device 1 of the present embodiment. FIG. 7(*b*) is a model diagram showing the electric field and charge distribution in the electrospinning device described in Patent Literatures 3 and 4 cited supra. As is apparent from the contrast between FIGS. 7(*a*) and 7(*b*), because in the embodiment of FIG. 7(*a*) the part of the nozzle 20 that is exposed to face the inner side of the electrode 10 is small, the area of the electrode 10 is far larger than the area of the nozzle 20 that is exposed to the inside space of the electrode 10. As a result, the nozzle 20 has a higher charge density and provides a stronger electric field than the electrode 10. On the other hand, according to the conventional technique shown in FIG. 7(*b*), because the nozzle 20' has not only the tip but the shaft thereof made of metal, the area of the nozzle 20' is larger than that of the ball electrode 10'. As a result, the nozzle 20' has a lower charge density and provides a weaker electric field than the electrode 10'. Thus, since the electrospinning device 1 of the present embodiment shown in FIG. 7(*a*) has a larger electrode area and a smaller metallic part of the nozzle than the conventional electrospinning device shown in FIG. 7(*b*), the electrospinning device 1 of the present embodiment has a stronger electric field (i.e., a higher charge density) at the tip of the nozzle, and the charges are concentrated at the tip of the nozzle. As a result, the spinning solution flowing through the nozzle acquires a much larger charge quantity.

The inventor further studied on the model shown in FIG. 7(*a*) and revealed that, with the area of the electrode being equal, more charges are concentrated at the tip of the nozzle 20 when in using the electrode 10 having the concave curved surface 11 illustrated in FIGS. 1 and 2 than in using a flat electrode as depicted in FIG. 7(*a*). That is, the charge quantity acquired by the spinning solution flowing through the nozzle 20 is considerably increased by making the inner side of the electrode 10 concavedly curved as in the present embodiment. In addition to that, a curved electrode requires a smaller space than a flat electrode, serving to size reduction of the electrospinning device 1. Furthermore, the absence of a moving part used in the electrospinning device described in Patent Literatures 1 and 2 makes the electrospinning device 1 simpler to advantage.

In order to ensure concentration of charges at the tip of the nozzle 20, it is advantageous that a direction in which the nozzle 20 extends pass through or near the center of the circle defined by the open end of the concave curved surface 11 of the electrode 10 and that the tip 20*a* of the nozzle 20 be positioned in or near the plane containing the circle defined by the open end.

It is desirable, in particular, that the direction in which the nozzle 20 extends pass through the center of the circle defined by the open end of the concave curved surface 11 of the electrode 10 and passes through the bottom of the concave curved surface 11, or the direction in which the nozzle 20 extends pass near the center of the circle defined by the open end of the concave curved surface 11 of the electrode 10 and passes through the bottom of the concave curved surface 11. It is especially desirable that the direction in which the nozzle 20 extends be perpendicular to the plane containing the circle defined by the open end of the concave curved surface 11. By so setting the nozzle 20, charges are assuredly to concentrate at the tip of the nozzle 20. From that point of view, it is particularly preferred for the concave curved surface 11 of the electrode 10 to have the shape of a nearly hemispherical shell.

The radius of the circle defined by the open end of the concave curved surface 11 of the electrode 10 being taken as r, when an imaginary circle, which is concentric with the circle defined by the open end and which has a radius of r/5, is drawn on the same plane including the circle defined by the open end, it is preferred that the direction in which the nozzle 20 extends pass within the imaginary circle and the bottom of the concave curved surface 11. Considering an imaginary circle which is drawn in the same manner and which has a radius of r/10, it is more preferred that the direction in which the nozzle 20 extends pass within the imaginary circle and the bottom of the concave curved surface 11. It is even more preferred that the direction in which the nozzle 20 extends pass through the center of the circle defined by the open end of the concave curved surface 11 of the electrode 10, and passes the bottom of the concave curved surface 11.

With regard to the position of the tip 20*a* of the nozzle 20, the nozzle 20 is preferably arranged in such a manner that the tip 20*a* is positioned in the plane containing the circle defined by the open end of the concave curved surface 11 of the electrode 10, or is positioned inside of the concave curved surface 11 from the plane, specifically 1 to 10 mm inside the plane. By so positioning the tip 20*a* of the nozzle 20, the spinning solution jetted from the tip 20*a* is hardly attracted to the concave curved surface 11 of the electrode 10 so that the concave curved surface 11 is hardly contaminated by the spinning solution.

As previously discussed, the electrospinning device 1 of the present embodiment is designed to reduce the area of the metallic part (conductive part) of the nozzle 20 that is exposed to the inside space of the electrode 10 (the space surrounded by the electrode 10) while increasing the area of the inner surface of the electrode 10, thereby to increase the charge density of the tip 20*a* of the nozzle 20. From that viewpoint, the ratio of the area of the inner surface of the electrode 10 to the area of the metallic part (conductive part) of the nozzle 20 exposed to the inside space of the electrode 10 is preferably 30 or higher, more preferably 100 or higher, and preferably 90000 or lower, more preferably 5000 or lower. For example, the area ratio is preferably 30 to 90000, more preferably 100 to 5000. As used herein, the term "area" of the metallic part (conductive part) of the nozzle 20 that is exposed to the inside space of the electrode 10 refers to the area of the lateral surface of the nozzle 20, and the area of the inner wall of the nozzle 20 is not included in that "area". The "area" of the inner surface of the electrode 10 does not contain the area of the opening into which the nozzle assembly 21 is fitted.

The area of the inner surface of the electrode 10 is preferably 400 $mm^2$ or more, more preferably 1000 $mm^2$ or more, and preferably 180000 $mm^2$ or less, more preferably 40000 $mm^2$ or less. For example, the area of the inner surface of the electrode 10 is preferably 400 $mm^2$ to 180000 $mm^2$, more preferably 1000 $mm^2$ to 40000 $mm^2$. The area of the metallic part (conductive part) of the nozzle 20 exposed to the inside space of the electrode 10 is preferably 2 $mm^2$ or more, more preferably 5 $mm^2$ or more, and preferably 1000 $mm^2$ or less, more preferably 100 $mm^2$ or less. For example, the area of the metallic part of the nozzle 20 exposed to the inside space of the electrode 10 is preferably 2 $mm^2$ to 1000 $mm^2$, more preferably 5 $mm^2$ to 100 $mm^2$.

As illustrated in FIGS. 1 and 2, the electrospinning device 1 of the present embodiment has a gas jetting part 23 near the base of the nozzle 20 of the nozzle assembly 21. The gas jetting part 23 is a through-conduit. The gas jetting part 23 extends along the direction in which the nozzle 20 extends and is configured to jet a gas stream therethrough toward the tip 20*a* of the nozzle 20. When the nozzle assembly 21 is viewed from the open end side of the electrode 10, there are two gas jetting parts 23 formed symmetrically about the nozzle 20. Each gas jetting part 23, which is the through-conduit, has its rear open end connected to a gas feed source (not shown). The gas jetting parts 23 are configured to jet a gas fed from the gas feed source from around the nozzle 20. The jetted gas carries a spinning solution, which is jetted from the tip 20*a* of the nozzle 20 and which is drawn into a fine fiber by the action of the electric field, to a collecting electrode hereinafter described. While the electrospinning device illustrated in FIGS. 1 and 2 has two gas jetting parts 23, the number of the gas jetting parts 23 to be provided is not limited to two and may be one or three or more. The cross-sectional shape of the gas jetting part is not limited to circular as illustrated and may be rectangular, elliptical, dual circular, triangular, or honey-comb. From the standpoint of forming a uniform gas jet stream, a ring shape encircling the nozzle is desirable. It is convenient to use air as the gas jetted from the gas jetting part 23.

Production of a nanofiber using the electrospinning device 1 of the present embodiment is achieved by jetting a spinning solution from the tip 20*a* of the nozzle 20 in a state that an electric field is generated between the electrode 10 and the nozzle 20. The spinning solution is charged by electrostatic induction by the time it reaches the tip of the nozzle 20 and jetted from the nozzle 20 as it is charged. Since electric charges are concentrated at the tip 20*a* of the nozzle 20, the charge quantity per unit mass of the spinning solution is very large. The spinning solution jetted as charged is deformed into a conical shape by the action of the electric field. If the attractive force of the electrode 10 exceeds the surface tension of the spinning solution, the jetted spinning solution is attracted toward the electrode 10 at a burst. At this timing, a gas stream is jetted from the gas jetting part 23 toward the jetted spinning solution, whereby the jetted stream of the spinning solution decreases in thickness to the order of nano size through concatenation of self-repulsion. At the same time, the fiber increases in specific surface area, and evaporation of the solvent is thus accelerated. As a result, a nanofiber formed on drying reaches and deposits randomly on an unshown collector disposed to face the nozzle 20. To secure deposition of the nanofiber on the collector, a nanofiber-collecting electrode (unshown) may be disposed to face the tip of the nozzle 20, and the collector is disposed between the collecting electrode and the nozzle 20 so as to be adjacent to the collecting electrode. It is preferred to apply a voltage of the polarity opposite to the charges of the charged spinning solution to the collecting electrode. For example, when the spinning solution is positively charged, the collecting electrode may be grounded or have a negative charge.

According to the above described method for producing a nanofiber, since the spinning solution jetted from the tip 20*a* of the nozzle 20 has an extremely large quantity of charges, there is exerted a great force for attracting the spinning solution toward the electrode 10. Therefore, even when the amount of the spinning solution to be jetted is increased over the conventional system, it is possible to produce nanofibers of the same fineness as achieved by the conventional system. Moreover, even when the jetted amount of the spinning solution is increased, the resulting nanofibers are less likely to involve defects, such as a solidified droplet of the spinning solution and a bead formed by solidification of an insufficiently drawn droplet of the spinning solution.

Figure 8:
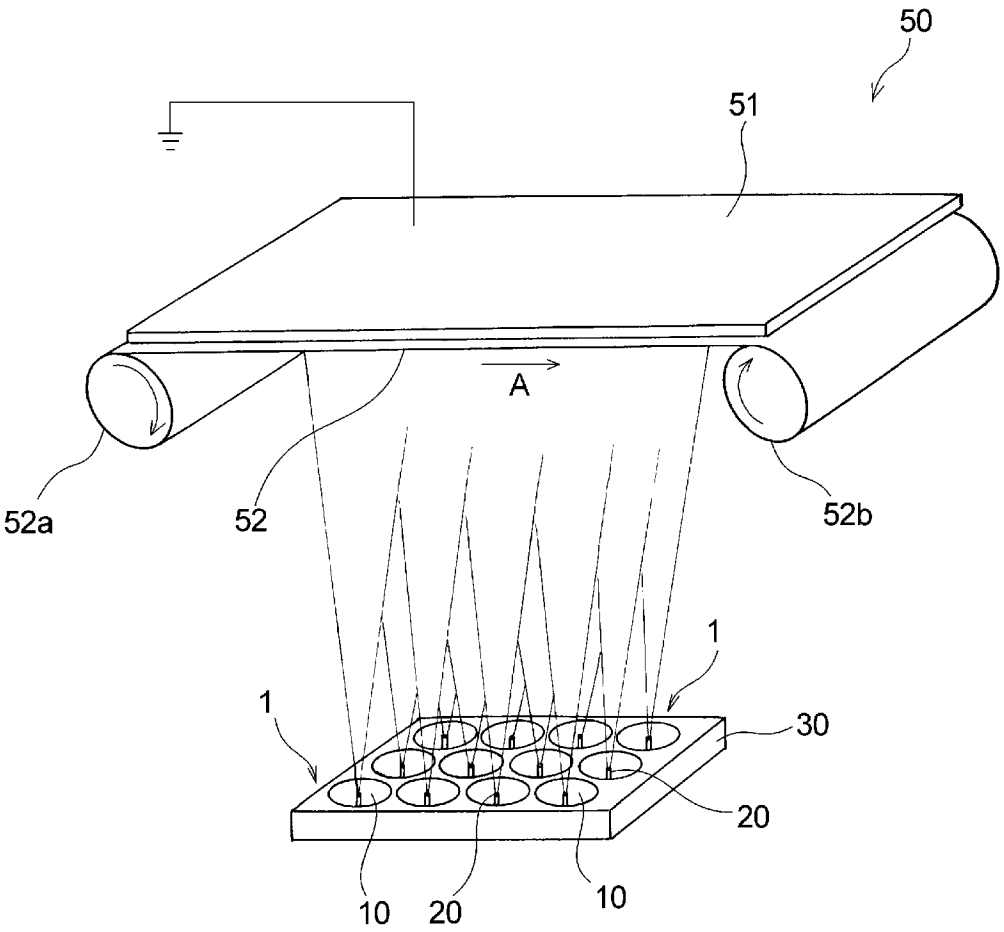
FIG. 8 schematically illustrates a nanofiber-producing apparatus having the electrospinning device shown in FIG. 1.

FIG. 8 illustrates an example of a nanofiber-producing apparatus 50 using the electrospinning device 1 of the present embodiment. The apparatus 50 of FIG. 8 includes a plurality of the electrospinning devices 1 illustrated in FIGS. 1 and 2. Each electrospinning device 1 is fixed into a plate-shaped base 30. A plurality of the electrospinning devices are arrayed two-dimensionally in the planar direction of the base 30. A plurality of the electrospinning devices 1 are arrayed in such a manner that each nozzles 20 points in the same direction (upward in FIG. 8). In each electrospinning device 1, a negative direct voltage is applied to the electrode 10 while the nozzle 20 is grounded. Because of the concave curved surface of the electrode 10 of the electrospinning device 1 according to the present embodiment, the electric field formed between the electrode 10 and the nozzle 20 is confined, so that the electric field is little influential on the surroundings. As a result, even when the plurality of electrospinning devices 1 are arrayed close to each other, their electric fields do not interfere with each other. This is extremely advantageous for size reduction of the nanofiber-producing apparatus 50. Furthermore, when the electrospinning devices 1 are closely packed to achieve an increased electrospinning device density, the resulting nonwoven fabric will have improved uniformity.

A nanofiber collecting electrode 51 is provided above the electrospinning devices 1 so as to face the tip of the nozzles 20. The collecting electrode 51 is a plate made of a conductor, such as metal. The main surface of the platy collecting electrode 51 is substantially perpendicular to the direction in which the nozzles 20 extend. The collecting electrode 51 is grounded. The distance between the collecting electrode 51 and the tip of the nozzles 20 is preferably 100 mm or longer, more preferably 500 mm or longer, and preferably 3000 mm or shorter, more preferably 1000 mm or shorter. For example, the distance between the collecting electrode 51 and the tip of the nozzles 20 is preferably 100 mm to 3000 mm, more preferably 500 mm to 1000 mm.

The apparatus 50 has a collector 52, on which nanofibers are to be collected, between the collecting electrode 51 and the nozzles 20 so as to be adjacent to the collecting electrode 51. The collector 52 has a continuous length and is unrolled from a stock roll 52*a*. The unrolled collector 52 runs in arrowed direction A in FIG. 8, passes above the nozzles 20 facing the nozzles 20, and is wound in a winder 52*b*. The collector 52 may be film, mesh, nonwoven fabric, paper, and the like.

In operating the apparatus 50 shown in FIG. 8, the collector 52 is unrolled and moved in the arrowed direction A, and a negative direct voltage is applied to the electrode 10 and the nozzles 20 and the collecting electrode 51 are connected to ground. In this state, a spinning solution is jetted from the tip 20*a* of the nozzles 20 while jetting a gas stream from the gas jetting parts 23 of the electrospinning devices 1. A nanofiber is formed from the jetted spinning solution and continuously deposited on the moving collector 52. Having the plurality of electrospinning devices 1, the apparatus 50 is capable of manufacturing a large quantity of nanofibers. Since the jetted spinning solution has an extremely large charge quantity, the rate of jetting the spinning solution may be increased to produce nanofibers with the same thickness as that of conventionally produced nanofibers, which also contributes to large volume production of nanofibers.

The spinning solution that can be used in the invention may be a solution of a fiber-forming polymer in a solvent. Such a polymer may be either water soluble or water insoluble. As used herein, the term "water soluble polymer" means a polymer having such water solubility that at least 50 mass % of the polymer dissolves in water when immersed in 10 or more times its mass of water for ample time (e.g., 24 hours or longer) in an environment of one atmosphere and ambient temperature (20° C.±15° C.). The term "water insoluble polymer" means a polymer having such water insolubility that 80 mass % or more of the polymer remains undissolved in water when immersed in 10 or more times its mass of water for ample time (e.g., 24 hours or longer) in an environment of one atmosphere and ambient temperature (20° C.±15° C.).

Examples of the water soluble polymer include naturally occurring polymers, such as mucopolysaccharides, e.g., pullulan, hyaluronic acid, chondroitin sulfate, poly-γ-glutamic acid, modified corn starch, β-glucan, gluco-oligosaccharide, heparin, and keratosulfate, cellulose, pectin, xylan, lignin, glucomannan, galacturonic acid, psyllium seed gum, tamarind seed gum, gum arabic, tragacanth gum, soybean water-soluble polysaccharide, alginic acid, carrageenan, laminaran, agar (agarose), fucoidan, methyl cellulose, hydroxypropyl cellulose, and hydroxypropylmethyl cellulose; or synthetic polymers, such as partially saponified polyvinyl alcohol (usable when not combined with a crosslinking agent hereinafter described), low-saponified polyvinyl alcohol, polyvinylpyrrolidone (PVP), polyethylene oxide, and sodium polyacrylate. These water soluble polymers may be used either individually or in combination of two or more thereof. Preferred of them are pullulan and synthetic polymers such as partially saponified polyvinyl alcohol, low-saponified polyvinyl alcohol, polyvinylpyrrolidone, and polyethylene oxide in view of ease of nanofiber production.

Examples of the water insoluble polymer include completely saponified polyvinyl alcohol that is insolubilizable after formation of nanofiber, partially saponified polyvinyl alcohol that is crosslinkable in the presence of a crosslinking agent after formation of nanofiber, oxazoline-modified silicones (e.g., a poly(N-propanoylethyleneimine) grafted dimethylsiloxane/γ-aminopropylmethylsiloxane copolymer), zein (main component of maize protein), polyesters, polylactic acid (PLA), acrylic resins (e.g., polyacrylonitrile resins and polymethacrylic acid resins), polystyrene resins, polyvinyl butyral resins, polyethylene terephthalate resins, polybutylene terephthalate resins, polyurethane resins, polyamide resins, polyimide resins, and polyamideimide resins. These water insoluble polymers may be used either individually or in combination of two or more thereof.

The nanofiber produced using the electrospinning device 1 of the present embodiment and the nanofiber-producing apparatus 50 usually has a thickness of 10 nm to 3000 nm, preferably 10 nm to 1000 nm, in terms of circle equivalent diameter. The thickness of nanofibers is measured by, for example, observation using a scanning electron microscope (SEM). Nanofibers having that thickness are randomly deposited to give a nanofiber sheet. The nanofiber sheet is suited for use as a high performance filter having high dust collecting capacity and low pressure loss, a separator for batteries that is permitted for use at a high current density, a cell culture substratum having a highly porous structure, and so forth.

Figure 9:
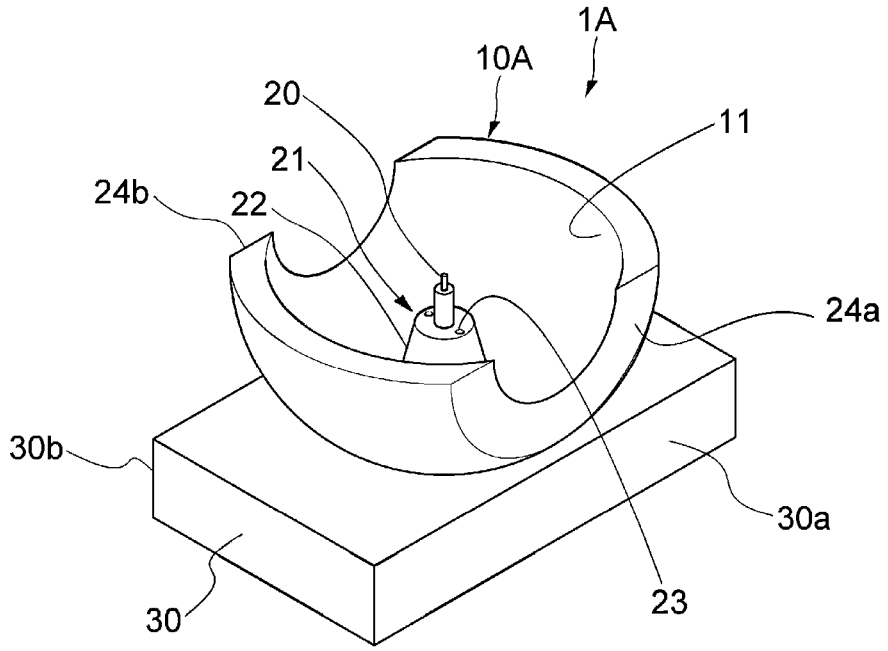
FIG. 9 is a perspective of another embodiment of the electrospinning device of the invention.

FIG. 9 illustrates a modification of the electrospinning device 1 of the embodiment shown in FIG. 1. The electrospinning device 1A of FIG. 9 is structurally the same as the device 1 of FIG. 1 except for the shape of the electrode 10A. The electrode 10A of the device 1A shown in FIG. 9 has a first truncated surface 24*a* and a second truncated surface 24*b* formed by truncating opposite two side portions of the generally bowl-shaped electrode 10 of the device 1 shown in FIG. 1 by the respective planes parallel to the direction in which the nozzle 20 extends. Accordingly, the two truncated surfaces 24*a* and 24*b* are parallel to each other. The distance from the nozzle 20 to the first truncated surface 24*a* and that to the second truncated surface 24*b* may be equal or different. The base 30 has a first edge face 30*a* and an opposing second edge face 30*b*. The first truncated surface 24*a* is preferably on the plane containing the first edge face 30*a*, and the second truncated surface 24*b* is preferably on the plane containing the second edge face 30*b*.

The electrode 10A of the electrospinning device 1A is preferably formed by cutting off at least 1% of the area of the inner surface of the electrode 10 shown in FIG. 1. The electrode 10A of the electrospinning device 1A is preferably formed by cutting off not more than 50%, more preferably not more than 20%, of the area of the inner surface of the electrode 10 shown in FIG. 1. For example, the electrode 10A of the electrospinning device 1A is preferably formed by cutting off 1% to 50%, more preferably 1% to 20%, of the area of the inner surface of the electrode 10 shown in FIG. 1.

Figure 10:
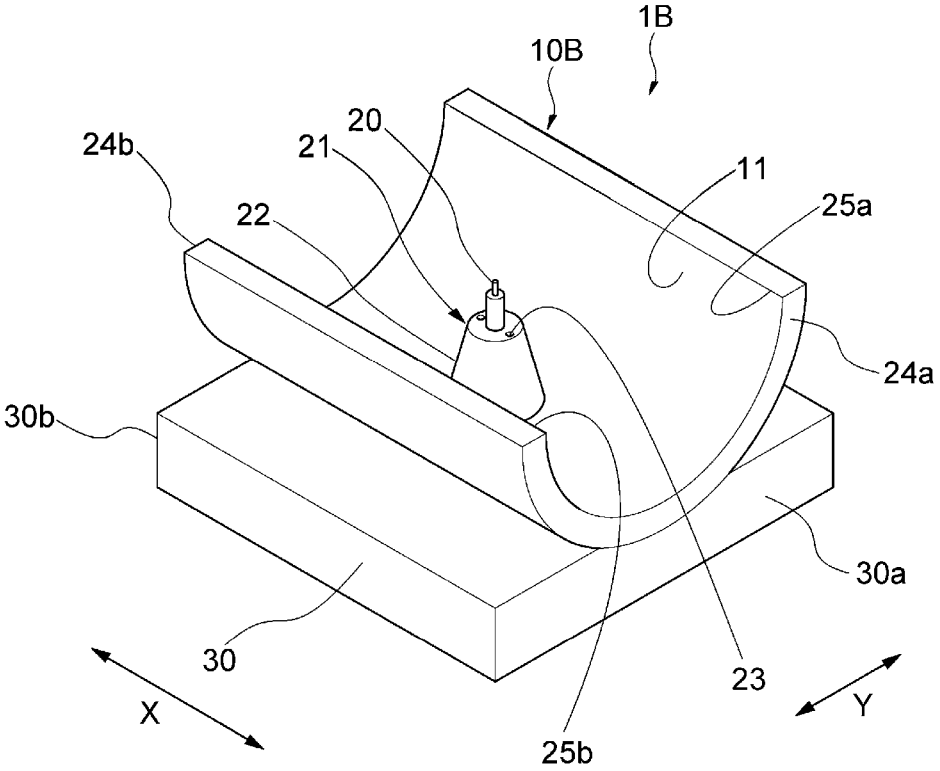
FIG. 10 is a perspective of still another embodiment of the electrospinning device of the invention.

FIG. 10 illustrates another modification of the electrospinning device 1 of the embodiment shown in FIG. 1. The electrospinning device 1B of FIG. 10 is structurally the same as the device 1 of FIG. 1 except for the shape of the electrode 10B. The electrode 10B of the device 1B shown in FIG. 10 has the shape of one of substantially equal halves of a cylinder as cut along the central axis thereof, namely a substantially semicylindrical shape. The term "cylinder" as used herein is meant to include not only a circular cylinder (whose cross-section is a circle) but also an elliptic cylinder (whose cross-section is an ellipse). In what follows, the electrode 10B will also be referred to as a semicylindrical electrode 10B. The semicylindrical electrode 10B is mounted on the base 30 with the central axis of the cylinder parallel to the horizontal direction and the inner side of the semicylinder facing outward. A nozzle assembly 21 is disposed at the bottom of the inner side of the semicylinder, i.e., at substantially the mid-point of the inner circumferential length of the semicylinder. The nozzle assembly 21 is positioned at the mid-point of the longitudinal direction X of the semicylindrical electrode 10B. The direction in which the nozzle 20 extends of the nozzle assembly 21 is perpendicular to a central axis of the cylinder. As used herein, the term "longitudinal direction X" means the central axial direction of the cylinder.

The semicylindrical electrode 10B has a first truncated surface 24*a* at one longitudinal end thereof and a second truncated surface 24*b* at the other longitudinal end thereof. The two truncated surfaces 24*a* and 24*b* are parallel to each other. The two truncated surfaces 24*a* and 24*b* are also parallel to the direction in which the nozzle 20 extends. The distance from the nozzle 20 to the first truncated surface 24*a* and that to the second truncated surface 24*b* may be equal or different. The first truncated surface 24*a* is preferably on the plane containing the first edge face 30*a* of the base 30, and the second truncated surface 24*b* is preferably on the plane containing the second edge face 30*b* of the base 30.

The semicylindrical electrode 10B preferably has a length in the longitudinal direction X of 10 mm or more, more preferably 20 mm or more, even more preferably 30 mm or more, and preferably 800 mm or less, more preferably 400 mm or less, even more preferably 200 mm or less. For example, the length of the semicylindrical electrode 10B in the longitudinal direction X is preferably 10 mm to 800 mm, more preferably 20 mm to 400 mm, even more preferably 30 mm to 200 mm. With the length of the semicylindrical electrode 10B falling within that range, the charges are efficiently concentrated at the tip of the nozzle 20.

The inner radius of the cylinder of the semicylindrical electrode 10B is preferably 10 mm or more, more preferably 20 mm or more, even more preferably 30 mm or more, and preferably 200 mm or less, more preferably 100 mm or less, even more preferably 50 mm or less. For example, the inner radius of the cylinder of the semicylindrical electrode 10B is preferably 10 mm to 200 mm, more preferably 20 mm to 100 mm, even more preferably 30 mm to 100 mm. With the inner radius of the semicylinder falling within that range, the charges are efficiently concentrated at the tip of the nozzle 20, and, when a plurality of the electrospinning devices 1B are arrayed in an adjacent relation, the adjacent electrospinning devices 1B are effectively prevented from interfering with each other.

In the semicylindrical electrode 10B, the central angle formed by the central axis of the cylinder and edges 25*a* and 25*b* at both ends of the electrode 10B in the transverse direction Y is preferably 120° or more, more preferably 150° or more, and preferably 270° or less, more preferably 210° or less. For example, the central angle is preferably 120° to 270°, more preferably 150° to 210°. With the above defined central angle falling within that range, the charges are sufficiently concentrated at the tip of the nozzle 20. Upon viewing the semicylinder from the size of the truncated surface 24*a* or 24*b*, the central angle as defined above is the angle formed in the side of the concave curved surface 11.

In the electrospinning devices 1A and 1B illustrated in FIGS. 9 and 10, the direction in which the nozzle 20 extends pass through or near the centroid of the plane defined by the open end of the concave curved surface of the electrode 10A or 10B and that the tip of the nozzle 20 be positioned in or near the plane defined by that open end. It is desirable, in particular, that the direction in which the nozzle 20 extends pass through the centroid of the plane defined by the open end of the concave curved surface of the electrode 10A or 10B and passes through the position which is located at the bottom of the concave curved surface and which is located closest to the nozzle 20, or the direction in which the nozzle 20 extends pass near the centroid of the plane defined by the open end of the concave curved surface of the electrode 10A or 10B and passes through the position which is located at the bottom of the concave curved surface and which is located closest to the nozzle 20. The term "centroid" is identical to the center of gravity (physical center of mass) in physics. Because the plane defined by the open end of the concave curved surface is an imaginary plane lacking mass, the term "centroid" is used in the description instead of "center of gravity".

The longest diagonal of the plane defined by the open end of the concave curved surface 11 of the electrode 10B being taken as L, when an imaginary circle, which has a radius of L/10 and which has a center coincident with that of the plane, is drawn on the same plane including the plane, it is preferred that the direction in which the nozzle 20 extends pass within the imaginary circle and the bottom of the concave curved surface 11. Considering an imaginary circle drawn in the same manner and having a radius of L/20, it is more preferred that the direction in which the nozzle 20 extends pass within the imaginary circle with a radius of L/20 and the bottom of the concave curved surface 11. It is even more preferred that the direction in which the nozzle 20 extends pass through the centroid of the plane defined by the open end of the concave curved surface 11 of the electrode 10B and passes the bottom of the concave curved surface 11.

It is preferred that a plurality of the electrospinning devices 1A or 1B of the embodiment shown in FIG. 9 or 10 be arrayed in the direction perpendicular to the truncated surfaces 24*a* and 24*b*, whereby the nanofiber-producing apparatus 50 illustrated in FIG. 8 is easily assembled. When a plurality of the electrospinning devices 1A or 1B are so arrayed, adjacent electrodes 10A or 10B of the electrospinning devices 1A or 1B are butted together so that the adjacent concave curved surfaces form a continuous space. This provides an advantage that can be used to easily carry out maintenance, such as cleaning, of the plurality of devices 1A or 1B at a time. For instance, the tip of the nozzles 20 may easily be cleaned by scraping with, for example, a string of fibers to prevent contamination of the tip of the nozzles 20 due to solidification of the spinning solution or adhesion of foreign matter, whereby nanofibers can be produced in a continuous manner without requiring human work. Furthermore, the tip of the plurality of nozzles can be observed at a time. For example, the condition of the tip of the plurality of nozzles may be observed along the longitudinal direction X at the same time. This facilitates timing for maintenance or early detection of the contamination or clogging of the tip of the nozzles 20, serving for stable operation of the apparatus.

The description about the electrospinning device 1 of FIG. 1 applies appropriately to the other details of the electrospinning devices 1A and 1B of FIGS. 9 and 10.

Figure 11:
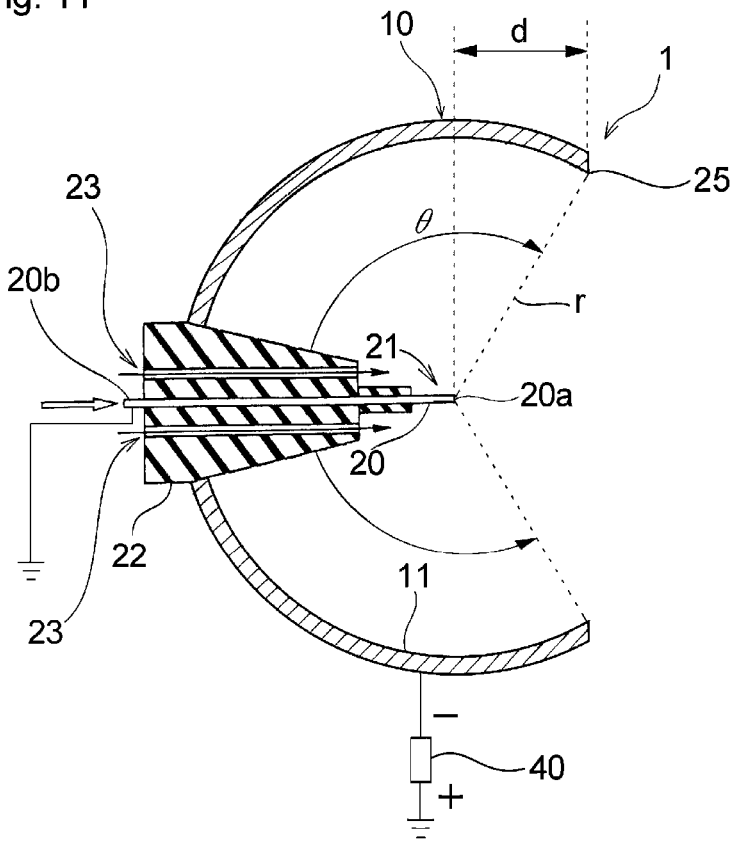
FIG. 11 is a schematic showing a cross-sectional structure of yet another embodiment of the electrospinning device (equivalent to FIG. 2).

While the invention has been described based on its preferred embodiments, it should be understood that the invention is not limited to these embodiments. For example, while the concave curved surface 11 of the electrode 10 preferably has the shape of the inner surface of a hemispherical shell, it may have the shape of the inner surface of a spherical crown shell as illustrated in FIG. 11. In that case, when the distance between the open end edge 25 of the concave curved surface 11 and the tip 20*a* of the nozzle 20 is taken as r, and the distance between the tip 20*a* of the nozzle 20 and the circle defined by the open end of the concave curved surface 11 is taken as d, the value d/r is preferably −0.5 or greater, more preferably −0.25 or greater, and preferably 0.71 or smaller, more preferably 0.25 or smaller. For example, the d/r is preferably −0.5 to 0.71, more preferably −0.25 to 0.25. The same preference applies to the electrodes 10A and 10B of the embodiments illustrated in FIGS. 9 and 10. Note that when the central angle θ (see FIG. 11) formed by the tip 20*a* of the nozzle 20 and the plane defined by the open end of the concave curved surface is smaller than 180°, the distance d is represented with a minus sign.

While in each of the above embodiments the nozzle 20 is disposed at the bottom of the concave curved surface 11, it may be set at other locations.

With regards to the foregoing embodiments, the following electrospinning devices and nanofiber-producing apparatuses are further disclosed.

[1]

An electrospinning device comprising an electrode having a concave curved surface and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution, the concave curved surface of the electrode having an open end defining a circle, the nozzle being located in such a manner that a direction in which the nozzle extends passes through or near the center of the circle defined by the open end of the concave curved surface of the electrode, and that the tip of the nozzle is positioned in or near a plane including the circle.

[2]

The electrospinning device as set forth in clause [1], wherein the concave curved surface has an opening at its bottom, a nozzle assembly is fitted into the opening, the nozzle assembly includes the nozzle and a support supporting the nozzle, the nozzle is made of an electrically conductive material such as metal, and the support is made of an electrically insulating material.

The electrospinning device as set forth in clause [1] or [2], wherein a ratio of an area of an inner surface of the electrode to an area of a metallic part (conductive part) of the nozzle exposed to the space surrounded by the electrode is preferably 30 or higher, more preferably 100 or higher, and preferably 90000 or lower, more preferably 5000 or lower, specifically preferably 30 to 90000, more preferably 100 to 5000.

[4]

The electrospinning device as set forth in any one of clauses [1] to [3], wherein an area of an inner surface of the electrode is preferably 400 $mm^2$ or more, more preferably 1000 $mm^2$ or more, and preferably 180000 $mm^2$ or less, more preferably 40000 $mm^2$ or less, specifically preferably 400 $mm^2$ to 180000 $mm^2$, more preferably 1000 $mm^2$ to 40000 $mm^2$.

The electrospinning device as set forth in any one of clauses [1] to [4], wherein the area of the metallic part (conductive part) of the nozzle exposed to the space surrounded by the electrode is preferably 2 $mm^2$ or more, more preferably 5 $mm^2$ or more, and preferably 1000 $mm^2$ or less, more preferably 100 $mm^2$ or less, and specifically preferably 2 $mm^2$ to 1000 $mm^2$, more preferably 5 $mm^2$ to 100 $mm^2$.

[6]

The electrospinning device as set forth in any one of clauses [1] to [5], wherein the concave curved surface is a concave, seemingly curved surface that is formed by connecting a plurality of segments each having a flat surface, or is a concave, seemingly curved surface that is formed by connecting a plurality of annular segments each having a belt-like portion with no curvature on one of three perpendicular axes.

[7]

The electrospinning device as set forth in clause [6], wherein the concave curved surface is formed by connecting segments having a rectangular flat surface of the same or different sizes having a length and a width ranging from about 0.5 to 5 mm.

[8]

The electrospinning device as set forth in clause [6], wherein the concave curved surface is formed by connecting annular segments having the shape of a flattened cylinder having a height of 0.001 to 5 mm and a varied radius.

[9]

The electrospinning device as set forth in any one of clauses [1] to [8], wherein the concave curved surface has such a curvature that a normal at any position the concave curved surface passes through or near the tip of the nozzle.

[10]

The electrospinning device as set forth in any one of clauses [1] to [9], wherein an inner diameter of the nozzle is preferably 200 μm or more, more preferably 300 μm or more, and preferably 3000 μm or less, more preferably 2000 μm or less, specifically preferably 200 μm to 3000 μm, more preferably from 300 μm to 2000 μm.

[11]

The electrospinning device as set forth in any one of clauses [1] to [10], wherein the nozzle is divided into a plurality of sections in its transverse cross-section, and the spinning solution is to flow through each of the plurality of sections.

[12]

The electrospinning device as set forth in clause [11], wherein the sections have the same or different shape or inner diameter.

[13]

The electrospinning device as set forth in any one of clauses [1] to [12], wherein the nozzle is grounded, and a negative voltage is applied to the electrode.

[14]

The electrospinning device as set forth in any one of clauses [1] to [13], wherein the direction in which the nozzle extends passes through the center of the circle which is defined by the open end of the concave curved surface of the electrode, and passes through a bottom of the concave curved surface, or the direction in which the nozzle extends passes near the center of the circle, which is defined by the open end of the concave curved surface of the electrode, and passes through the bottom of the concave curved surface.

[15]

The electrospinning device as set forth in any one of clauses [1] to [13], wherein the direction in which the nozzle extends passes within an imaginary circle and a bottom of the concave curved surface, the imaginary circle being drawn on the same plane including the circle defined by the open end of the concave curved surface of the electrode, being concentric with the circle, and having a radius of r/5, wherein r is the radius of the circle defined by the open end of the concave curved surface of the electrode.

[16]

The electrospinning device as set forth in any one of clauses [1] to [13], wherein the direction in which the nozzle extends passes within an imaginary circle and a bottom of the concave curved surface, the imaginary circle being drawn on the same plane including the circle defined by the open end of the concave curved surface of the electrode, being concentric with the circle, and having a radius of r/10, wherein r is the radius of the circle defined by the open end of the concave curved surface of the electrode.

[17]

The electrospinning device as set forth in any one of clauses [1] to [13], wherein the direction in which the nozzle extends passes through the center of the circle defined by the open end of the concave curved surface of the electrode and passes a bottom of the concave curved surface.

[18]

The electrospinning device as set forth in any one of clauses [1] to [17], wherein the tip of the nozzle is positioned in a plane containing the circle, or is positioned inside of the concave curved surface from the plane.

[19]

The electrospinning device as set forth in clause [18], wherein the tip of the nozzle is positioned 1 to 10 mm inside the plane.

The electrospinning device as set forth in clause [19], wherein the tip of the nozzle is positioned 5 mm inside the plane.

[21]

The electrospinning device as set forth in any one of clauses [1] to [20], wherein the concave curved surface has a shape of a nearly true hemispherical shell.

[22]

An electrospinning device comprising an electrode having a concave curved surface and a needle-shaped spinning nozzle surrounded by the concave curved surface of the electrode and being configured to jet a spinning solution from the tip of the nozzle with an electric field applied between the electrode and the nozzle to form a nanofiber from the jetted spinning solution, the concave curved surface of the electrode having an open end defining a plane, and the nozzle being located in such a manner that a direction in which the nozzle extends passes through or near the centroid of the plane defined by the open end of the concave curved surface of the electrode, and that the tip of the nozzle is positioned in or near the plane defined by the open end of the concave curved surface of the electrode.

[23]

The electrospinning device as set forth in clause [22], wherein the concave curved surface of the electrode is a concave, seemingly curved surface formed by connecting a plurality of segments each having a flat surface.

[24]

The electrospinning device as set forth in clause [22] or [23], wherein the direction in which the nozzle extends passes through or near the centroid of the plane which is defined by the open end of the concave curved surface of the electrode, and passes through the position which is located at a bottom of the concave curved surface and which is located closest to the nozzle.

[25]

The electrospinning device as set forth in any one of clauses [22] to [24], wherein the direction in which the nozzle extends passes within an imaginary circle and through the position which is located at the bottom of the concave curved surface and which is located closest to the nozzle, the imaginary circle being drawn on the plane defined by the open end of the concave curved surface, having a radius of L/10 and having a center coincident with the centroid of the plane, wherein L is the longest diagonal of the plane.

[26]

The electrospinning device as set forth in any one of clauses [22] to [24], wherein the direction in which the nozzle extends passes within an imaginary circle and through the position which is located at the bottom of the concave curved surface and which is located closest to the nozzle, the imaginary circle being drawn on the plane defined by the open end of the concave curved surface, having a radius of L/20, and having a center coincident with the centroid of the plane, wherein L is the longest diagonal of the plane.

[27]

The electrospinning device as set forth in any one of clauses [22] to [24], wherein the direction in which the nozzle extends passes through the centroid of the plane defined by the open end of the concave curved surface and passes through a bottom of the concave curved surface.

[28]

The electrospinning device as set forth in any one of clauses [22] to [27], wherein the tip of the nozzle is positioned in the plane which is defined by the open end of the concave curved surface of the electrode, the tip of the nozzle is positioned inside a space defined by the plane and the concave curved surface.

[29]

The electrospinning device as set forth in any one of clauses [22] to [28], wherein the concave curved surface of the electrode has a substantially bowl shape, and the electrode has a first truncated surface and a second truncated surface formed by truncating opposite two side portions of the substantially bowl shape by two planes parallel to the direction in which the nozzle extends.

[30]

The electrospinning device as set forth in any one of clauses [22] to [28], wherein the concave curved surface has a substantially semicylinder shape.

[31]

An apparatus for producing a nanofiber comprising:

the electrospinning device as set forth in any one of clauses [1] to [30], a gas jetting part positioned near a base of the nozzle of the electrospinning device and configured to jet a gas stream along a direction, in which the nozzle extends, toward the tip of the nozzle, a nanofiber collecting electrode facing the tip of the nozzle, and a spinning solution feed unit for feeding the spinning solution to the nozzle.

[32]

The apparatus as set forth in clause [31], wherein the gas jetting part includes a plurality of gas jetting parts.

[33]

The apparatus as set forth in clauses [31] or [32], wherein the gas jetting part has a ring shape encircling the nozzle.

[34]

The apparatus as set forth in any one of clauses [31] to [33], wherein a distance between the nanofiber collecting electrode and the tip of the nozzle is preferably 100 mm or longer, more preferably 500 mm or longer, preferably 3000 mm or shorter, more preferably 1000 mm or shorter, and specifically preferably 100 mm to 3000 mm, more preferably 500 mm to 1000 mm.

[35]

The apparatus as set forth in any one of clauses [31] to [34], wherein a plurality of the electrospinning device is arranged in such a manner that each nozzle of the electrospinning devices points in the same direction.

[36]

The apparatus as set forth in any one of clauses [31] to [35], wherein the electrode has a first truncated surface and a second truncated surface formed by truncating opposite two side portions thereof by two planes parallel to the direction in which the nozzle extends, and a plurality of electrospinning devices are arranged along the direction perpendicular to the truncated surfaces in such a manner that the truncated surfaces of adjacent the electrospinning devices being in contact with each other.

[37]

The apparatus as set forth in any one of clauses [31] to [35], further comprising a collector on which a nanofiber is to be collected, the collector being arranged between the nanofiber collecting electrode and the nozzle so as to be adjacent to the nanofiber collecting electrode, and being configured to move in one direction.

[38]

A method for producing a nanofiber comprising jetting a charged spinning solution from the tip of the nozzle in a state that an electric field is generated between an electrode having a concave curved surface and a needle-shaped spinning nozzle surrounded by the concave curved surface of the electrode, jetting a gas stream toward the jetted spinning solution to form a nanofiber, and depositing the nanofiber on a surface of a collector.

[39]

A method for producing a nanofiber comprising using the apparatus for producing a nanofiber as set forth in any one of clauses [31] to [37].

EXAMPLES

The invention will now be illustrated in greater detail by way of Examples, but it should be noted that the invention is not construed as being limited thereto. Unless otherwise noted, all the percents are by mass.

Example 1

A nanofiber was produced using the electrospinning device 1 illustrated in FIGS. 1 and 2. The production was carried out at 23° C. and 40% RH. The electrode 10 of the electrospinning device 1 was designed to have a concave curved surface 11 shaped to the inner surface of a true hemispherical shell. The circle defined by the open end of the concave curved surface 11 had a diameter of 90 mm. The area of the electrode was 8478 $mm^2$. The metallic part of the nozzle 20 that was exposed to the space surrounded by the electrode 10 had a surface area of 42 $mm^2$. The inner diameter of the nozzle was 600 μm. The tip of the nozzle 20 was positioned 5 mm inside the plane containing the circle defined by the open end of the concave curved surface 11. The nozzle assembly 21 including the nozzle 20 was set at the bottom of the concave curved surface 11 of the electrode 10. The nozzle 20 was located so that a direction in which the nozzle 20 extends passed through the center of the circle defined by the open end of the concave curved surface 11 of the electrode 10. The collecting electrode 51 was placed 1000 mm distant from the tip of the nozzle. A direct voltage of −15 kV was applied to the electrode 10. The nozzle 20 and the collecting electrode 51 were grounded. A spinning solution was continuously jetted at a rate of 1.0 g/min over 10 minutes while jetting air from the gas jetting parts 23 of the nozzle assembly 21 at a rate of 200 mL/min. A 15% aqueous solution of pullulan was used as the spinning solution. The nanofiber formed by the jetting was deposited on a polyethylene terephthalate (PET) film disposed to adjoin the collecting electrode 51. There was thus obtained a nanofiber.

Comparative Example 1

Comparative Example 1 was carried out in the same manner as in Example 1 of Patent Literature 4, which corresponds to the model diagram shown in FIG. 7(*b*), except for jetting a 15% pullulan aqueous solution as a spinning solution at a rate of 1.0 g/min and applying a voltage of −35 kV to the nanofiber forming part, to obtain a nanofiber.

Comparative Example 2

A nanofiber was obtained in the same manner as in Comparative Example 1, except for reducing the rate of jetting the spinning solution to 0.1 g/min.

Evaluation:

The nanofibers obtained in Example and Comparative Examples were observed under a scanning electron microscope. The results are displayed in FIGS. 12 through 14. As is apparent from FIG. 12, the nanofiber of Example 1 had very few droplets of the spinning solution that had solidified as such and very few beads formed by solidification of insufficiently drawn droplets of the spinning solution. The thickness of the nanofiber as actually measured from FIG. 12(*b*) was about 200 nm.

In contrast, the nanofiber of Comparative Example 1, in which the rate of jetting the spinning solution was equal to that of Example 1, was observed to have droplets of the spinning solution that had solidified as such (black spots in FIG. 13(*a*)) and beads formed by solidification of insufficiently drawn droplets of the spinning solution (white spots in FIG. 13(*c*)). The thickness of the nanofiber as actually measured from FIG. 13(*b*) was about 500 nm, which was larger than the thickness of the nanofiber of Example 1.

Even in Comparative Example 2, in which the rate of jetting the spinning solution was as low as 1/10 that in Example 1, the presence of droplets of the spinning solution that had solidified as such (black spots in FIG. 14(*a*)) and beads formed by solidification of insufficiently drawn droplets of the spinning solution (white spots in FIG. 14(*b*)) was observed. The thickness of the nanofiber as actually measured from FIG. 14(*b*) was about 400 nm, larger than that of the nanofiber of Example 1 despite the fact that the rate of jetting the spinning solution was as small as 1/10 that in Example 1.

INDUSTRIAL APPLICABILITY

The invention provides an electrospinning device and a nanofiber-producing apparatus by which increased nanofiber productivity and space saving are achieved.

The invention claimed is:

1. An electrospinning device comprising an electrode having a concave curved surface on an inner wall, wherein the concave curved surface is curved at every portion, and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution, the concave curved surface of the electrode having an open end defining a circle, with:

the nozzle being located in such a manner that a direction in which the nozzle extends passes through the center of said circle defined by the open end of the concave curved surface of the electrode, and that the tip of the nozzle is positioned in a plane including the circle defined by the open end of the concave curved surface of the electrode, or is positioned inside the concave curved surface from said plane;

wherein the electrode and the nozzle are electrically insulated from each other by a support, and wherein the concave curved surface has a shape of a true hemispherical shell.

2. The electrospinning device according to claim 1, wherein the concave curved surface is a concave, curved surface that is formed by connecting a plurality of segments each having a flat surface, or is a concave, curved surface that is formed by connecting a plurality of annular segments each having a belt-like portion with no curvature on one of three perpendicular axes.

3. The electrospinning device according to claim 1, wherein the nozzle is divided into a plurality of sections in its transverse cross-section, and the spinning solution is to flow through each of the plurality of sections.

4. The electrospinning device according to claim 1, wherein the direction in which the nozzle extends passes through the center of the circle defined by the open end of the concave curved surface of the electrode, and passes through a bottom of the concave curved surface, or the direction in which the nozzle extends passes through the center of the circle defined by the open end of the concave curved surface of the electrode, and passes through the bottom of the concave curved surface.

5. The electrospinning device according to claim 1, wherein the tip of the nozzle is positioned in a plane containing the circle, or is positioned inside of the concave curved surface from the plane.

6. The electrospinning device according to claim 1, wherein a gas jetting part is positioned adjacent to a base of the nozzle of the electrospinning device and configured to jet a gas stream along a direction, in which the nozzle extends, toward the tip of the nozzle.

7. An electrospinning device comprising an electrode having a concave curved surface on an inner wall, wherein the concave curved surface is curved at every portion, and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution, the concave curved surface of the electrode having an open end defining a circle, with:

the nozzle being located in such a manner that a direction in which the nozzle extends passes through the center of said circle defined by the open end of the concave curved surface of the electrode, and the tip of the nozzle is positioned in a plane including said circle defined by the open end of the concave curved surface of the electrode, or is positioned inside the concave curved surface from said plane;

the concave curved surface has a curvature such that a normal at every position of the concave curved surface passes through the tip of the nozzle; and wherein the electrode and the nozzle are electrically insulated from each other by a support.

8. An electrospinning device comprising an electrode having a concave curved surface on an inner wall, wherein the concave curved surface has a shape of true hemispherical shell, and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution, the concave curved surface of the electrode having an open end defining a circle, with:

(1) the nozzle being located in such a manner that a direction in which the nozzle extends passes through the center of said circle defined by the open end of the concave curved surface of the electrode, and that the tip of the nozzle is positioned in a plane including the circle defined by the open end of the concave curved surface of the electrode, or is positioned inside the concave curved surface from said plane, or (2) the nozzle being located in such a manner that a direction in which the nozzle extends passes within an imaginary circle, the imaginary circle being drawn on the same plane including said circle defined by the open end of the of the concave curved surface of the electrode, being concentric with said circle, and having a radius of r/5, wherein r is the radius of said circle defined by the open end of the concave curved surface of the electrode, and the tip of the nozzle is positioned in a plane including said circle defined by the open end of the concave curved surface of the electrode, or is positioned inside the concave curved surface from said plane; and wherein the electrode and the nozzle are electrically insulated from each other by a support.

9. An electrospinning device comprising an electrode having a concave curved surface on an inner wall, wherein the concave curved surface is curved at every portion, and a needle-shaped spinning nozzle surrounded by the concave curved surface of the electrode and being configured to jet a spinning solution from a tip of the nozzle with an electric field applied between the electrode and the nozzle to form a nanofiber from the jetted spinning solution, the concave curved surface of the electrode having an open end defining a circle, with:

the nozzle being located in such a manner that a direction in which the nozzle extends passes through the center of said circle defined by the open end of the concave curved surface of the electrode, and that the tip of the nozzle is positioned in a plane including the circle defined by the open end of the concave curved surface of the electrode, or is positioned inside the concave curved surface from said plane; and wherein:

the nozzle is insulated, said electrode has an inner surface area of 400 $mm^2$ to 180000 $mm^2$, said tip of the nozzle contains a metallic part (conductive part) having a surface area of 2 $mm^2$ to 1000 $mm^2$ that is exposed to the inner surface area of the electrode, and a ratio of the said inner surface area of the electrode to the surface area of the tip of the nozzle exposed to the inner surface of the electrode is 30 to 90000.

* * * * *